US009712908B2

(12) United States Patent
Van Der Werf

(10) Patent No.: US 9,712,908 B2
(45) Date of Patent: Jul. 18, 2017

(54) ADAPTIVE RESIDUAL FEEDBACK SUPPRESSION

(71) Applicant: GN Hearing A/S, Ballerup (DK)

(72) Inventor: Erik Cornelis Diederik Van Der Werf, Eindhoven (NL)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/074,152

(22) Filed: Nov. 7, 2013

(65) Prior Publication Data

US 2015/0125015 A1 May 7, 2015

(30) Foreign Application Priority Data

Nov. 5, 2013 (DK) ..... 2013 70645
Nov. 5, 2013 (EP) ..... 13191660

(51) Int. Cl.
*H04R 25/00* (2006.01)
*H04R 1/10* (2006.01)
*H04R 3/00* (2006.01)

(52) U.S. Cl.
CPC ..... *H04R 1/1091* (2013.01); *H04R 3/002* (2013.01); *H04R 25/45* (2013.01); *H04R 25/453* (2013.01); *H04R 25/305* (2013.01)

(58) Field of Classification Search
USPC ..... 381/318, 93
See application file for complete search history.

(56) References Cited

U.S. PATENT DOCUMENTS 5,259,033 A 11/1993 Goodings et al.
5,619,580 A 4/1997 Hansen
6,754,356 B1 6/2004 Luo et al.
(Continued)

FOREIGN PATENT DOCUMENTS

EP 1191814 3/2002
EP 1080606 1/2004
(Continued)

OTHER PUBLICATIONS

European Office Action dated Oct. 29, 2014 for related EP Patent Application No. 09 180 287.6, 5 pages.
(Continued)

*Primary Examiner* — Amir Etesam
(74) *Attorney, Agent, or Firm* — Vista Law Group, LLP

(57) ABSTRACT

A hearing aid includes: an input transducer for generating an audio signal; a feedback suppression circuit configured for modelling a feedback path of the hearing aid; a subtractor for subtracting an output signal of the feedback suppression circuit from the audio signal to form a feedback compensated audio signal; a signal processor that is coupled to an output of the subtractor for processing the feedback compensated audio signal to perform hearing loss compensation; and a receiver that is coupled to an output of the signal processor for converting the processed feedback compensated audio signal into a sound signal; wherein the hearing aid further comprises a gain processor for performing gain adjustment of the feedback compensated audio signal based at least on an estimate of a residual feedback signal of the feedback compensated audio signal, wherein the estimate of the residual feedback signal is based at least on the audio signal.

16 Claims, 8 Drawing Sheets

(56) References Cited

U.S. PATENT DOCUMENTS

| | | | | |
|---|---|---|---|---|
| 6,757,396 | B1 * | 6/2004 | Allred | H03G 7/007 381/106 |
| 6,876,751 | B1 | 4/2005 | Gao et al. | |
| 8,116,489 | B2 | 2/2012 | Mejia et al. | |
| 2002/0057814 | A1 | 5/2002 | Kaulberg | |
| 2002/0076072 | A1 | 6/2002 | Cornelisse | |
| 2002/0094100 | A1 | 7/2002 | Kates et al. | |
| 2003/0053647 | A1 | 3/2003 | Kates | |
| 2008/0273728 | A1 * | 11/2008 | Tjalfe Klinkby | H04R 25/453 381/318 |

FOREIGN PATENT DOCUMENTS

| | | |
|---|---|---|
| EP | 1439736 | 7/2004 |
| EP | 1830602 | 9/2007 |
| EP | 2 217 007 | 2/2009 |
| EP | 2 136 575 | 6/2009 |
| EP | 2 203 000 | 12/2009 |
| EP | 2203000 | 6/2010 |
| JP | 2008-523746 | 7/2008 |
| WO | WO99/51059 | 10/1999 |
| WO | WO03/015468 | 2/2003 |
| WO | WO 2006/063624 | 6/2006 |
| WO | WO2006/063624 | 6/2006 |
| WO | WO2008/065209 | 6/2008 |

OTHER PUBLICATIONS

International Search Report and Written Opinon dated Jan. 23, 2015 for related PCT Patent Application No. PCT/EP2014/073711.

Second Technical Examination—Intention to Grant dated Aug. 28, 2014 for related Danish Patent Application No. PA 2013 70645.

Non-final Office Action dated Jul. 31, 2014 for U.S. Appl. No. 12/353,107.

Advisory Action dated May 8, 2014 for U.S. Appl. No. 12/353,107.

Extended European Search Report for EP Patent Application No. 13191660.3 dated Mar. 27, 2014.

Final Office Action dated Dec. 4, 2013 for U.S. Appl. No. 12/353,107.

Final Office Action dated Mar. 28, 2012 for U.S. Appl. No. 12/353,107.

Non-Final Office Action dated Jul. 11, 2011 for U.S. Appl. No. 12/353,107.

Non-Final Office Action dated Jun. 7, 2013 for U.S. Appl. No. 12/353,107.

Advisory Action dated Jun. 5, 2012 for U.S. Appl. No. 12/353,107.

JP Notice of Reasons for Rejection dated Oct. 23, 2012, for JP Patent Application No. 2009-291277.

Office Action dated Jul. 1, 2009 for Danish Patent Application No. PA 2008 01839.

International Type Search Report dated Sep. 22, 2009 for DK 200801839.

First Technical Examination and Search Report dated Feb. 5, 2014 for related Danish Patent Application No. PA 2013 70645, 5 pages.

Final Office Action dated Jul. 2, 2015 for U.S. Appl. No. 12/353,107.

Non-final Office Action dated Mar. 28, 2016 for related U.S. Appl. No. 12/353,107.

European Communication pursuant to Article 94(3) EPC dated Jan. 28, 2016 for related EP Patent Application No. 13191660.3, 4 pages.

Final Office Action dated Jan. 13, 2017 for related U.S. Appl. No. 12/353,107.

* cited by examiner

ADAPTIVE RESIDUAL FEEDBACK SUPPRESSION

RELATED APPLICATION DATA

This application claims priority to and the benefit of Danish Patent Application No. PA 2013 70645, filed on Nov. 5, 2013, and European Patent Application No. EP 13191660.3, filed on Nov. 5, 2013. The entire disclosures of both of the above identified applications are expressly incorporated by reference herein.

FIELD

An embodiment described herein relates to hearing device, such as hearing aid.

BACKGROUND

In a hearing aid, acoustical signals arriving at a microphone of the hearing aid are amplified and output with a small loudspeaker to restore audibility. The small distance between the microphone and the loudspeaker may cause feedback. Feedback is generated when a part of the amplified acoustic output signal propagates back to the microphone for repeated amplification. When the feedback signal exceeds the level of the original signal at the microphone, the feedback loop becomes unstable, possibly leading to audible distortions or howling. To stop the feedback, the gain has to be turned down.

The risk of feedback limits the maximum gain that can be used with a hearing aid.

It is well-known to use feedback suppression in a hearing aid. With feedback suppression, the feedback signal arriving at the microphone is suppressed by subtraction of a feedback model signal from the microphone signal. The feedback model signal is provided by a digital feedback suppression circuit configured to model the feedback path of propagation along which an output signal of the hearing aid propagates back to an input of the hearing aid for repeated amplification. The transfer function of the receiver (in the art of hearing aids, the loudspeaker of the hearing aid is usually denoted the receiver), and the transfer function of the microphone are included in the model of the feedback path of propagation. Thus, the feedback suppression circuit adapts its transfer function to match the corresponding transfer function of the feedback path as closely as possible.

The digital feedback suppression circuit may include one or more digital adaptive filters to model the feedback path. An output of the feedback suppression circuit is subtracted from the audio signal of the microphone to remove the feedback signal part of the audio signal.

In a hearing aid with more than one microphone, e.g. having a directional microphone system, the hearing aid may comprise separate digital feedback suppression circuits for individual microphones and groups of microphones.

Ideally, the feedback part of the audio signal is removed completely so that only an external signal generated in the surroundings of the hearing aid is amplified in the hearing aid. In practice, however, the feedback suppression circuit cannot model the feedback path perfectly; leaving an undesired residual feedback signal for amplification. Near instability, the residual feedback signal may cause the hearing aid output level to exceed the desired output level.

EP 2 203 000 A1 discloses a hearing aid with suppression of residual feedback utilizing an adaptive feedback gain circuit wherein the level of residual feedback is estimated based on the hearing aid gain and a feedback path model as determined during power up or during fitting of the hearing aid.

SUMMARY

A new method for performing adaptive feedback suppression in a hearing aid and a hearing aid utilizing the method are provided. According to the method, residual feedback is estimated and reduced. The estimate of residual feedback is based on features of an input signal of the hearing aid.

A new method and a new hearing aid are provided in which residual feedback is suppressed based on another estimate of residual feedback.

According to the new method, and in the new hearing aid, residual feedback is reduced by gain adjustments based on an estimate of the residual feedback signal, wherein the estimate is based on an input signal of the hearing aid, such as a power spectrum of the input signal.

Thus, a new method of suppressing residual feedback is provided, comprising converting an acoustic signal into an audio signal, modelling a feedback path with a feedback suppression circuit receiving an input signal based on the audio signal, and generating an output signal, subtracting the output signal of the feedback suppression circuit from the audio signal to form a feedback compensated audio signal, determining an estimate of a residual feedback signal part of the feedback compensated audio signal based at least on the audio signal, and applying a gain to the feedback compensated audio signal based at least on the estimate.

The method may further comprise monitoring the feedback path, wherein the estimate of the residual feedback signal part is based on a result from the act of monitoring.

Further, a new hearing aid is provided, comprising an input transducer for generating an audio signal, a feedback suppression circuit configured for modelling a feedback path of the hearing aid, a subtractor for subtracting an output signal of the feedback suppression circuit from the audio signal to form a feedback compensated audio signal, a signal processor that is connected to an output of the subtractor for processing the feedback compensated audio signal to perform hearing loss compensation, and a receiver that is connected to an output of the signal processor for converting the processed feedback compensated audio signal into a sound signal, the hearing aid further comprising:

a gain processor for performing gain adjustment of the feedback compensated audio signal based at least on an estimate of a residual feedback signal of the feedback compensated audio signal, wherein the estimate of the residual feedback signal is based at least on the audio signal.

A transducer is a device that converts a signal in one form of energy to a corresponding signal in another form of energy. For example, the input transducer may comprise a microphone that converts an acoustic signal arriving at the microphone into a corresponding analogue audio signal in which the instantaneous voltage of the audio signal varies continuously with the sound pressure of the acoustic signal. Preferably, the input transducer comprises a microphone.

The input transducer may also comprise a telecoil that converts a magnetic field at the telecoil into a corresponding analogue audio signal in which the instantaneous voltage of the audio signal varies continuously with the magnetic field strength at the telecoil. Telecoils may be used to increase the signal to noise ratio of speech from a speaker addressing a number of people in a public place, e.g. in a church, an auditorium, a theatre, a cinema, etc., or through a public address systems, such as in a railway station, an airport, a shopping mall, etc. Speech from the speaker is converted to a magnetic field with an induction loop system (also called "hearing loop"), and the telecoil is used to magnetically pick up the magnetically transmitted speech signal.

The input transducer may further comprise at least two spaced apart microphones, and a beamformer configured for combining microphone output signals of the at least two spaced apart microphones into a directional microphone signal, e.g. as is well-known in the art.

The input transducer may comprise one or more microphones and a telecoil and a switch, e.g. for selection of an omni-directional microphone signal, or a directional microphone signal, or a telecoil signal, either alone or in any combination, as the audio signal.

The output transducer preferably comprises a receiver, i.e. a small loudspeaker, which converts an analogue audio signal into a corresponding acoustic sound signal in which the instantaneous sound pressure varies continuously in accordance with the amplitude of the analogue audio signal.

The analogue audio signal may be made suitable for digital signal processing by conversion into a corresponding digital audio signal in an analogue-to-digital converter whereby the amplitude of the analogue audio signal is represented by a binary number. In this way, a discrete-time and discrete-amplitude digital audio signal in the form of a sequence of digital values represents the continuous-time and continuous-amplitude analogue audio signal.

A part of the output signal may propagate from the output transducer back to the input transducer both along an external signal path outside the hearing aid housing and along an internal signal path inside the hearing aid housing.

Acoustical feedback occurs, e.g., when a hearing aid ear mould does not completely fit the wearer's ear, or in the case of an ear mould comprising a canal or opening for e.g. ventilation purposes. In both examples, sound may "leak" from the receiver back to the microphone and thereby cause feedback.

Mechanical feedback may be caused by mechanical vibrations in the hearing aid housing and in components inside the hearing aid housing. Mechanical vibrations may be generated by the receiver and are transmitted to other parts of the hearing aid, e.g. through receiver mounting(s). In some hearing aids, the receiver is flexibly mounted in the housing, whereby transmission of vibrations from the receiver to other parts of the hearing aid is reduced.

Internal feedback may also be caused by propagation of an electromagnetic field generated by coils in the receiver to the telecoil.

Throughout the present disclosure, a part of the audio signal generated by the hearing aid itself, e.g., in response to sound, mechanical vibration, and electromagnetic fields is termed the feedback signal part of the audio signal; or in short, the feedback signal.

A difference between the feedback signal part of the audio signal and the output signal of the feedback suppression circuit is termed the residual feedback signal part of the audio signal; or in short, the residual feedback signal.

An external feedback path extends "around" the hearing aid and is therefore usually longer than an internal feedback path, i.e. sound has to propagate a longer distance along the external feedback path than along the internal feedback path to get from the receiver to the microphone. Accordingly, when sound is emitted from the receiver, the part of it propagating along the external feedback path will arrive at the microphone with a delay in comparison to the part propagating along the internal feedback path. Therefore, separate digital feedback suppression circuits may operate on first and second time windows, respectively, wherein at least a part of the first time window precedes the second time window. Whether the first and second time windows overlap or not, depends on the length of the impulse response of the internal feedback path.

While external feedback may vary considerably during use, internal feedback may be more constant and may be coped with during manufacturing.

Open solutions may lead to feedback paths with long impulse responses, since the receiver output is not separated from the microphone input by a tight seal in the ear canal.

A hearing aid with a housing that does not obstruct the ear canal when the housing is positioned in its intended operational position in the ear canal; is categorized "an open solution". The term "open solution" is used because of a passageway is formed between a part of the ear canal wall and a part of the housing allowing sound waves to escape from behind the housing between the ear drum and the housing through the passageway to the surroundings of the user. With an open solution, the occlusion effect is diminished and preferably substantially eliminated.

A standard sized hearing aid housing which fits a large number of users with a high level of comfort may represent an open solution.

As already mentioned, the risk of feedback limits the maximum gain that can be achieved with a hearing aid.

It would be desirable to be able to remove the feedback signal part of the audio signal from the audio signal.

Therefore a feedback suppression circuit is provided in the hearing aid, configured for modelling the feedback path, i.e. desirably the feedback suppression circuit has the same transfer function as the feedback path itself so that an output signal of the feedback suppression circuit matches the feedback signal part of the audio signal as closely as possible.

A subtractor is provided for subtraction of the output signal of the feedback suppression circuit from the audio signal to form a feedback compensated audio signal in which the feedback signal has been removed or at least reduced.

The feedback suppression circuit may comprise an adaptive filter that tracks the current transfer function of the feedback path.

However, as discussed above, limitations in the tracking performance of the feedback suppression circuit may leave a residual feedback signal part in the audio signal formed by a difference between the estimated feedback signal and the actual feedback signal.

According to the new method and in the new hearing aid, a gain processor is provided for improved feedback suppression. The gain processor is configured for compensating for the residual feedback signal by applying a gain to the feedback compensated audio signal based on an improved estimate of the residual feedback signal based at least on the audio signal, e.g. a power spectrum of the audio signal.

The gain processor desirably applies a gain to the feedback compensated audio signal so that the resulting loudness of the output signal of the hearing aid substantially equals the loudness that would have been obtained with no residual feedback signal.

For example, the estimate of the residual feedback signal part of the audio signal on the input signal may include an analysis of the input spectrum of the audio signal for detection of high risk of feedback, or feedback, e.g. in the event that the feedback suppression circuit provides insufficient information to prevent feedback.

The feedback suppression circuit may be configured during an initialization of the hearing aid, and the estimate of the residual feedback signal may further be based on a configuration of the feedback suppression circuit achieved during the initialization of the hearing aid.

Initialization may be performed during turn-on of the hearing aid and/or during fitting as disclosed in EP 2 203 000 A1.

The feedback suppression circuit may have a configuration that is variable, and the estimate of the residual feedback signal may further be based on a configuration of the feedback suppression circuit as determined during a current operation of the hearing aid. The estimate of the residual feedback signal may thus be based on an updated feedback suppression circuit as determined during current operation of the hearing aid modelling the feedback path, e.g. following slow variations of the feedback path as for example resulting from a re-insertion of the hearing aid in the ear canal of the user, build-up of ear wax, aging of electronic components, etc.

The estimate of the residual feedback signal may further be based on a gain value of the hearing aid.

The feedback suppression circuit may comprise one or more adaptive filters.

The estimate of the residual feedback signal may be based on filter coefficients of the one or more adaptive filters.

The gain adjustment may be performed separate from hearing loss compensation, preferably before bearing loss compensation.

The estimate of the residual feedback signal may include an estimate of an adaptive broad-band contribution β.

The signal processor may be configured to perform multi-band hearing loss compensation in a set of frequency bands k, wherein the estimate of the residual feedback signal comprises individual estimates of the residual feedback signal in respective frequency bands k.

The estimates $R_k$ of residual feedback signal in the respective frequency bands k may be given by:

$$|R_k|=\beta|A_k||B_k|$$

and an amount $\alpha_k$ of the gain adjustment may be calculated from:

$$\alpha_k^2 = \frac{1}{(1+\beta^2|G_k|^2|A_k|^2|B_k|^2)}$$

wherein

β is a scaling term relating the residual feedback to a feedback reference, $A_k$ is a feedback reference gain obtained using the feedback suppression circuit, and $B_k$ is a contribution from the audio signal.

The feedback suppression circuit may comprise an adaptive filter, and β may be calculated from:

$$\beta = \frac{\left(\left(c_s\left\|\overrightarrow{h_{emp}} * \vec{w}\right\|\right)^q + \left(c_d\left\|\overrightarrow{h_{emp}} * (\vec{w} - \overrightarrow{w_{ref}})\right\|\right)^q\right)^{\frac{1}{q}}}{\sigma_{norm}},$$

wherein q is an integer,

|| || indicates a p-norm of a vector, p is a positive integer, such as the 1-norm, the 2-norm, the 3-norm, etc, preferably the 1-norm, $c_s$ is a scaling factor relating to the accuracy of the feedback suppression circuit in modelling the feedback path in static situations, $c_d$ is a scaling factor relating to the accuracy of the feedback suppression circuit in modelling the feedback path in dynamic situations, $\overrightarrow{h_{emp}}$ represents a filter for emphasizing certain frequencies, $\vec{w}$ is the coefficient vector of the adaptive filter, $\overrightarrow{w_{ref}}$ is the reference coefficient vector of the adaptive filter, and $\sigma_{norm}$ is a low-pass filtered feedback suppression circuit norm $\sigma_{norm}=\mathrm{lpf}(\|\overrightarrow{h_{emp}}*\vec{w}\|)$.

Frequency emphasis may be omitted, i.e. $\overrightarrow{h_{emp}}$ may be equal to one.

q may be equal to 2:

$$\beta = \frac{\sqrt{\left(c_s\left\|\overrightarrow{h_{emp}} * \vec{w}\right\|\right)^2 + \left(c_d\left\|\overrightarrow{h_{emp}} * (\vec{w} - \overrightarrow{w_{ref}})\right\|\right)^2}}{\sigma_{norm}},$$

and for large values of $q\rightarrow\infty$:

$$\beta = \frac{\max\left(c_s\left\|\overrightarrow{h_{emp}} * \vec{w}\right\|,\ c_d\left\|\overrightarrow{h_{emp}} * (\vec{w} - \overrightarrow{w_{ref}})\right\|\right)}{\sigma_{norm}}.$$

The hearing aid may further comprise attack and release filters configured for smoothing process parameters in the gain processor.

The estimate of the residual feedback signal part of the audio signal, based on the input signal may include an analysis of the input spectrum of the audio signal for detection of feedback, e.g. in the event that the feedback suppression circuit provides insufficient information to prevent feedback.

Monitoring the feedback suppression circuit improves the estimate of the residual feedback signal part of the audio signal, especially upon detection of a significant change of the feedback suppression circuit modelling the feedback path, such as bringing a phone to the ear with the hearing aid. Such a feedback path change may cause a significant increase of the magnitude of the residual feedback signal until the feedback suppression circuit has had time to adjust to the change. Such an increase may be adequately estimated due to the monitoring.

The hearing aid may be a multi-band hearing aid performing hearing loss compensation differently in different frequency bands, thus accounting for the frequency dependence of the hearing loss of the intended user. In the multi-band hearing aid, the audio signal from the input transducer is divided into two or more frequency channels or bands; and the audio signal may be amplified differently in each frequency band. For example, a compressor may be utilized to compress the dynamic range of the audio signal in accordance with the hearing loss of the intended user. In a multi-band hearing aid, the compressor performs compression differently in each of the frequency bands varying not only the compression ratio, but also the time constants associated with each band. The time constants refer to compressor attack and release time constants. The compressor attack time is the time required for the compressor to lower the gain at the onset of a loud sound. The release time is the time required for the compressor to increase the gain after the cessation of the loud sound.

The feedback suppression circuit, e.g. including one or more adaptive filters, may be a broad band circuit, i.e. the circuit may operate substantially in the entire frequency range of the hearing aid, or in a significant part of the frequency range of the hearing aid, without being divided into a set of frequency bands.

Alternatively, the feedback suppression circuit may be divided into a set of frequency bands for individual modelling of the feedback path in each frequency band. In this case, the estimate of the residual feedback signal may be provided individually in each frequency band m of the feedback suppression circuit.

The frequency bands m of the feedback suppression circuit and the frequency bands k of the hearing loss compensation may be identical, but preferably, they are different, and preferably the number of frequency bands m of the feedback suppression circuit is less than the number of frequency bands of the hearing loss compensation.

Throughout the present disclosure, the term audio signal is used to identify any analogue or digital signal forming part of the signal path from an output of the microphone to an input of the processor.

The feedback suppression circuit may be implemented as a dedicated electronic hardware circuit or may form part of a signal processor in combination with suitable signal processing software, or may be a combination of dedicated hardware and one or more signal processors with suitable signal processing software.

Signal processing in the new hearing aid may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

Other and further aspects and features will be evident from reading the following detailed description.

BRIEF DESCRIPTION OF THE FIGURES

The drawings illustrate the design and utility of embodiments, in which similar elements are referred to by common reference numerals. These drawings may or may not be drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

Below, the new method and hearing aid are explained in more detail with reference to the drawings in which.

DETAILED DESCRIPTION

Figure 1:
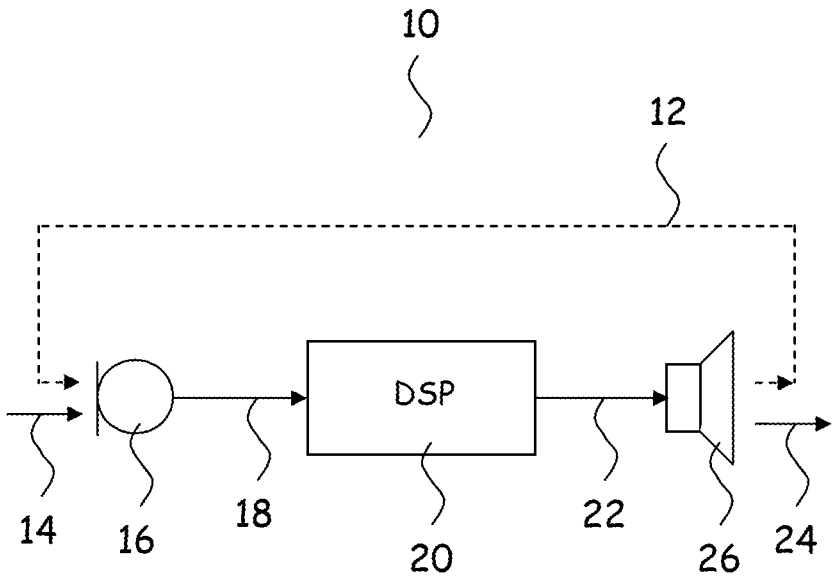
FIG. 1 schematically illustrates a hearing aid.

Various embodiments are described hereinafter with reference to the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The new method and hearing aid according to the appended claims may be embodied in different forms not shown in the accompanying drawings and should not be construed as limited to the examples set forth herein. Like reference numerals refer to like elements throughout. Like elements will, thus, not be described in detail with respect to the description of each figure.

FIG. 1 schematically illustrates a hearing aid 10 and a feedback path 12 along which signals generated by the hearing aid 10 propagates back to an input of the hearing aid 10.

In FIG. 1, an acoustical signal 14 is received at a microphone 16 that converts the acoustical signal 14 into an audio signal 18 that is input to the signal processor 20 for hearing loss compensation. In the signal processor 20, the audio signal 18 is amplified in accordance with the hearing loss of the user. The signal processor 20 may for example comprise a multi-band compressor. The output signal 22 of the signal processor 20 is converted into an acoustical output signal 24 by the receiver 26 that directs the acoustical signal towards the eardrum of the user when the hearing aid is worn in its proper operational position at an ear of the user.

A part of the acoustical signal 24 from the receiver 26 propagates back to the microphone 16 as indicated by feedback path 12 in FIG. 1.

At low gains, feedback only introduces harmless colouring of sound. However, with large hearing aid gain, the feedback signal level at the microphone 16 may exceed the level of the original acoustical signal thereby causing audible distortion and possibly howling.

Figure 2:
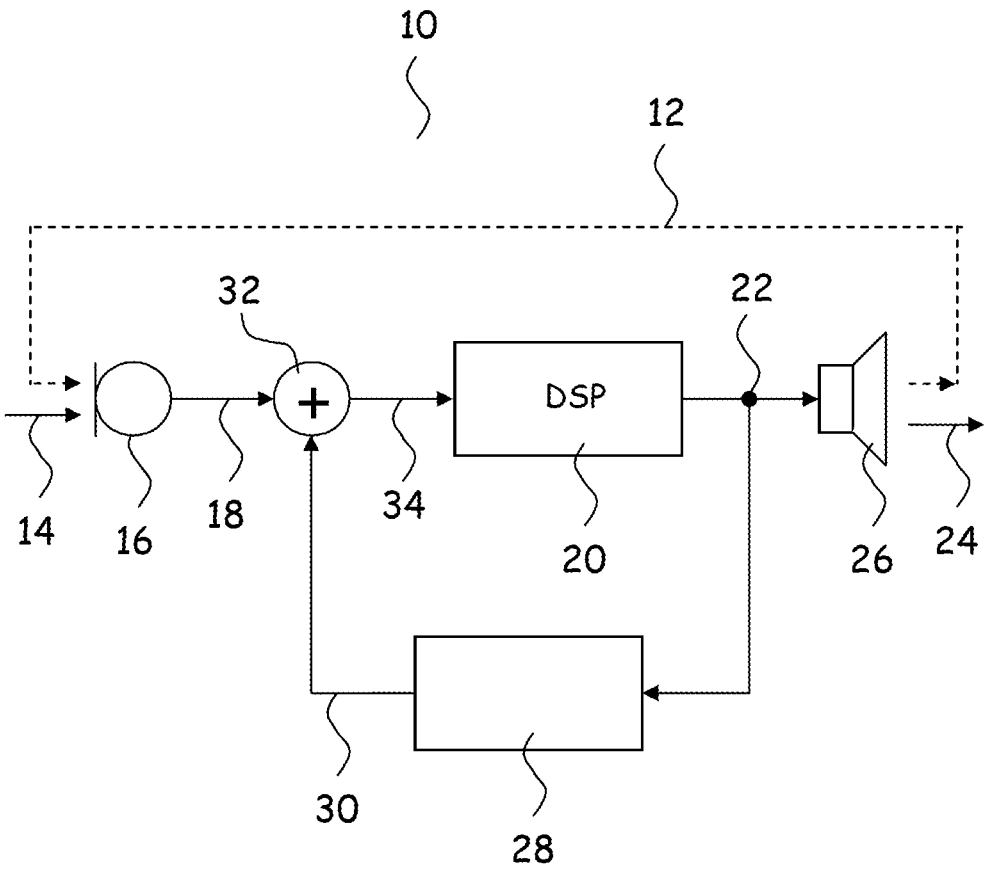
FIG. 2 schematically illustrates a hearing aid with feedback suppression.

To overcome feedback, it is well-known to provide feedback suppression circuitry in a hearing aid as shown in FIG. 2.

FIG. 2 schematically illustrates a hearing aid 10 with a feedback suppression circuit 28. The feedback suppression circuit 28 models the feedback path 12, i.e. the feedback suppression circuit 28 seeks to generate a signal that is identical to the signal propagated along the feedback path 12 i.e. the feedback suppression circuit 28 adapts its transfer function to match the corresponding transfer function of the feedback path as closely as possible. It is noted that the feedback suppression circuit 28 includes models of the receiver 26 and the microphone 16.

In the hearing aid 10, the feedback suppression circuit 28 may be an adaptive digital filter which adapts to changes in the feedback path 12.

The feedback suppression circuit 28 generates an output signal 30 to the subtractor 32 in order to suppress or cancel the feedback signal part of the audio signal 18 before processing takes place in the signal processor 20.

In the event that the feedback suppression circuit 28 does not model the feedback path 12 accurately, a fraction of the feedback signal, the residual feedback signal, remains in the feedback compensated audio signal 34.

Figure 3:
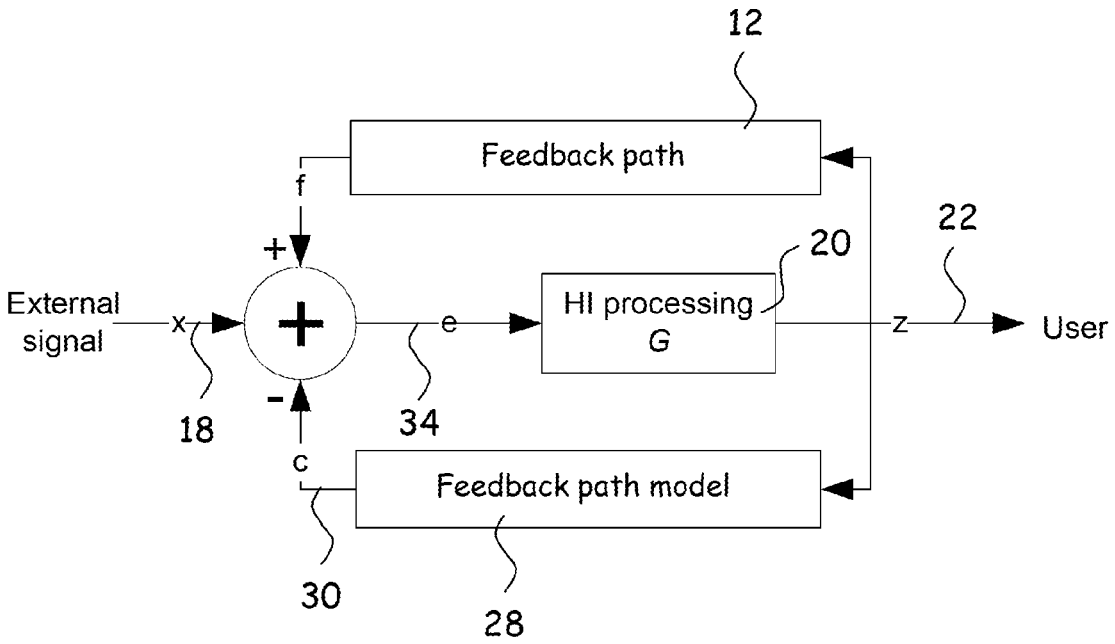
FIG. 3 is a conceptual schematic illustration of feedback suppression in a hearing aid, FIG. 4 schematically illustrates a conceptual model for feedback suppression with a gain processor, FIG. 5 schematically illustrates a hearing aid with adaptive feedback suppression with a gain processor.

FIG. 3 schematically illustrates a linear model of signal processing and signals in a hearing aid. The feedback suppression circuit 28 models the transfer functions of the real feedback path 12, including the receiver (not shown), microphone (not shown), and possible other analogue components (not shown). The feedback suppression circuit 28 is configured to output a signal c 30 to be subtracted from the audio signal x 18 thereby eliminating, or at least substantially reducing, the feedback signal f. Unfortunately, the feedback suppression circuit 28 cannot exactly model the real feedback path 12, whereby a residual feedback signal part remains in the feedback compensated audio signal e 34.

In the following, lower case characters will be used for time domain signals and functions, while upper case characters will be used for their z-transforms.

With reference to FIG. 3, the residual feedback signal R is the difference between the real feedback signal F and the output of the feedback suppression circuit C:

$$R=F-C \tag{1}$$

In the linear model shown in FIG. 3, the output/input transfer function is given by:

$$H=\frac{Z}{X}=\frac{G}{1-GR}. \tag{2}$$

It should be noted that the effective gain provided by the hearing aid approximates G, G being the gain of the hearing aid, when $|GR|<<1$, i.e. when the residual feedback signal level is very small. With high gains G and/or significant residual feedback R, the GR term cannot be neglected, and $|H|$ will differ from the desired gain G.

Figure 4:
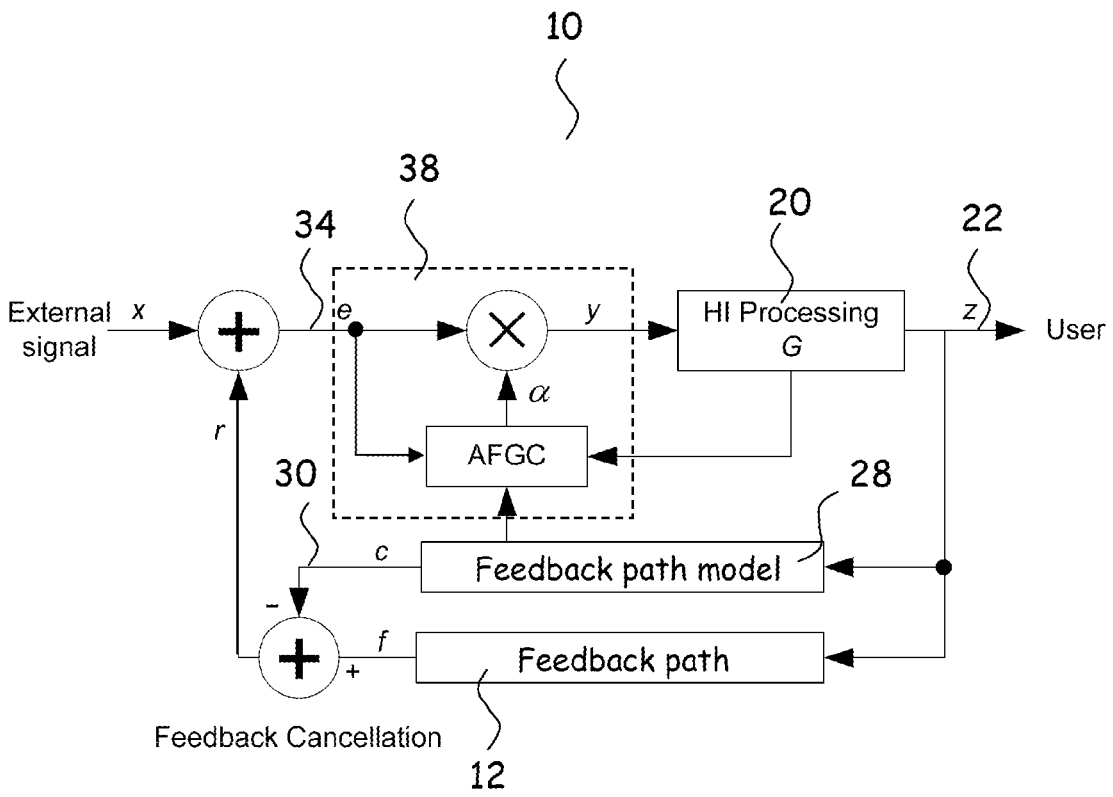

FIG. 4 schematically illustrates an exemplary new hearing aid 10 with a gain processor 38 that is configured for applying a gain $\alpha$ to the feedback compensated audio signal 34 so that the effect on the residual feedback signal is reduced.

Thus, desirably, the gain $\alpha$ is determined so that $$E[x^2]=E[y^2] \tag{3}$$

where x is the external part of the audio signal generated by other sound sources than the hearing aid itself, and e is the feedback compensated audio signal 34, whereby the signal magnitude after gain multiplication corresponds to the magnitude of the audio signal in absence of residual feedback.

It should be noted that in FIG. 4, the signals x, r, and f are not present individually in the hearing aid circuitry, while the signals e, c, y, and z are present individually in the hearing aid circuitry.

For ease of notation, the expectation operator E[.] is left out below, and the variance is used instead. All signals have zero mean.

Under the assumption that the residual feedback signal R and the audio signal X are uncorrelated, which is a reasonable assumption because the feedback suppression circuit 28 operates in such a way that it minimizes correlations, then the signal power of the feedback compensated signal e is given by $$\sigma_e^2=\sigma_x^2+\sigma_r^2. \tag{4}$$

Alternatively, a worst case value for the feedback compensated signal e could be obtained by summing amplitude values of signals x and r, however it is presently preferred to use equation (4).

Applying gain $\alpha$ then gives $$\sigma_y^2=\alpha^2\sigma_e^2, \tag{5}$$

which ideally matches the external signal power $\sigma_x^2$ (see below).

Applying the hearing aid gain G and propagating through the residual feedback suppression circuit gives $$\sigma_r^2=|GR|^2\sigma_y^2=\alpha^2|GR|^2\sigma_e^2 \tag{6}$$

Combining all of the above gives the following estimate for the signal power of signal e $$\alpha^2\sigma_e^2=(1-\alpha^2|GR|^2)\sigma_e^2 \tag{7}$$

this is solved for the squared gain:

$$\alpha^2=\frac{1}{(1+|GR|^2)} \tag{8}$$

Estimation of R is disclosed below.

Figure 5:
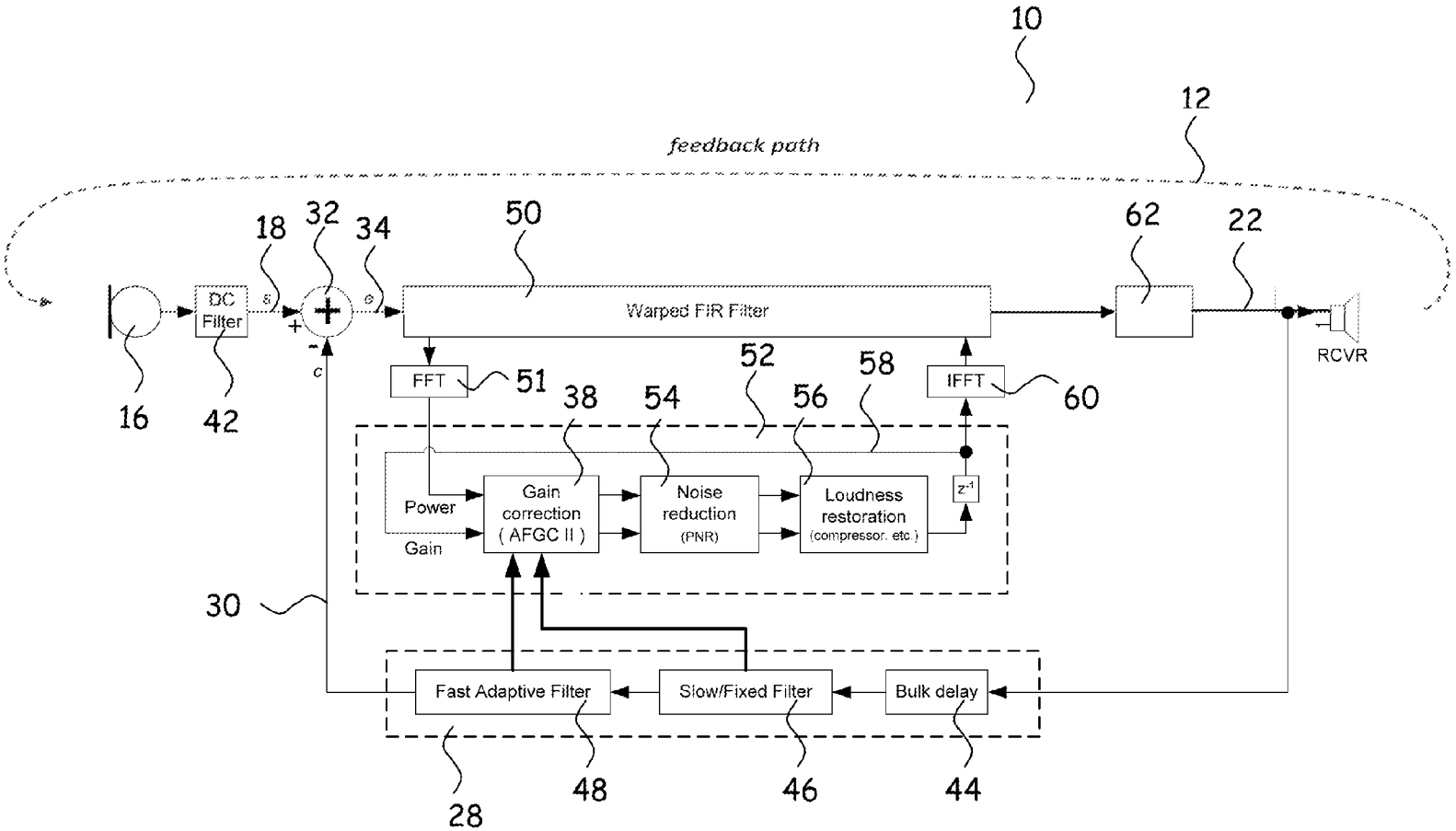

FIG. 5 schematically illustrates an exemplary new hearing aid with a gain processor 38. The hearing aid 10 illustrated in FIG. 5 corresponds to the known hearing aid illustrated in FIG. 5 of EP 2 203 000 A1; however the new hearing aid provides an improved estimate of the residual feedback signal R as explained below in more detail.

The hearing aid 10 of FIG. 5, has a compressor that performs dynamic range compression using digital frequency warping of the kind disclosed in more detail in WO 03/015468, in particular the basic operating principles of the warped compressor are illustrated in FIG. 10 and the corresponding parts of the description of WO 03/015468. The hearing aid 10 illustrated in FIG. 5 corresponds to the hearing aid of FIG. 10 of WO 03/015468; however feedback suppression and gain processing and noise reduction have been added in the signal processing of the hearing aid 10. Other processing circuitry may be added as well.

In another exemplary hearing aid, the gain processor 38 may be employed with non-warped frequency bands.

The hearing aid schematically illustrated in FIG. 5 has a single microphone 16. However, the hearing aid 10 may comprise two or more microphones, possibly with a beamformer. These components are not shown for simplicity. Similarly, possible A/D and D/A converters, buffer structures, optional additional channels, etc, are not shown for simplicity.

An incoming acoustical signal received by the microphone 16 is passed through a DC filter 42 which ensures that the signals have a mean value of zero; this is convenient for calculating the statistics as discussed previously. In another exemplary hearing aid, the signal received by the microphone 16 may be passed directly to the subtractor 32.

As already explained, feedback suppression may be applied by subtracting an estimated feedback signal c from the audio signal s. The feedback signal estimate 30 is provided by the feedback suppression circuit 28. In the example illustrated in FIG. 5, the feedback suppression circuit 28 comprises a series connection of a delay 44, a slow adaptive or fixed filter 46, and a fast adaptive filter 48 operating on the output signal z of the hearing aid 10.

In principle only one fast adaptive filter 48 is necessary; the fixed or slow adaptive filter(s) 46 and bulk delay 44 are incorporated here for efficiency and performance. A fixed or slow adaptive filter 46 may be an all-pole or general infinite impulse response (IIR) filter initialized at a certain point in time, for example upon turn on in the ear of the hearing aid, or, during fitting, while a slow adaptive filter 46 and the fast adaptive filter 48 are preferably finite impulse response (FIR) filters, but in principle any other adaptive filter structure (lattice, adaptive IIR, etc.) may be used.

In a preferred embodiment the fast adaptive filter 48 is an all zero filter.

In the illustrated hearing aid 10, the feedback suppression circuit 28 is a broad-band system, i.e. the feedback suppression circuit 28 operates in the entire frequency range of the multi-band hearing aid 10. However, like the audio signal from the input transducer may be divided into two or more frequency channels or bands k for individual processing in each frequency band; the input signal 22 to the feedback suppression circuit 28 may also be divided into a number of frequency bands m for individual feedback suppression in each frequency band m of the feedback suppression circuit 28. The frequency bands k of the audio signal and the frequency bands m of the feedback suppression circuit 28 may be identical, but they may be different, and preferably, the feedback suppression circuit 28 has a fewer number of frequency bands m than the frequency divided audio signal.

The output signal 30 of the feedback suppression circuit 28 is subtracted from the audio signal 18 and transformed to the frequency domain. As explained in more detail in WO 03/015468, in particular in FIG. 10 and the corresponding parts of the description of WO 03/015468, the hearing aid 10 illustrated in FIG. 5 has a side-branch structure 52 where the analysis of the signal is performed outside a main signal path 50; and signal shaping is performed using a time domain-filter constructed from outputs of the side-branch 52.

A warped side-branch system 52 has advantages for high quality low-delay signal processing, but in principle any textbook FFT-system, a multi-rate filter bank, or a non-warped side-branch system may be used. Thus, although it is convenient to use frequency warping, it is not at all necessary in order to exercise the new method of estimating the residual feedback signal.

In the illustrated hearing aid 10 of FIG. 5, a warped FIR filter 50 is provided for generation of warped frequency bands. The warped FIR filter 50 is obtained by substitution of the unit delays of a tapped delay line of a FIR filter with all pass filters as is well-known in the art and e.g. as explained in WO 03/015468. A power estimate is formed in each warped frequency band with an FFT operation 51. A side branch 52 is formed having a chain of so-called gain agents 38, 54, 56 that analyze the respective power estimates and adjust gains applied individually to the respective signals in each of the warped frequency bands in a specific order. In the hearing aid 10 illustrated in FIG. 5, the order of the gain agents is: gain processor 38, noise reduction 54, and loudness restoration 56. In other examples of the new hearing aid, the order of the gain agents 38, 54, 56 may be different.

In order to estimate the residual feedback signal, the first gain agent, i.e. the gain processor 38, receives input from FFT processor 51 providing power estimates of the feedback compensated audio signal 34 in the warped frequency bands. In addition, the gain processor 38 receives input from the feedback suppression circuit 28, and finally, the gain vector in the frequency domain output by loudness restoration processor 56 as calculated in the previous iteration (representing the current gains as applied by the warped FIR filter 50) is also input to the gain processor 38.

The estimation of the residual feedback and calculation of gain values performed by the gain processor 38 based on these inputs is further explained below.

The second gain agent 54 shown here, providing noise reduction, is optional. Noise reduction is a comfort feature which is often used in modern hearing aids. Together, the first two gain agents 38, 54 seek to shape the audio signal in such a way that the envelope of the original signal is restored without undesired noise or feedback.

Finally, the third gain agent 56 adjusts loudness in order to compensate for the hearing loss of the intended user. A significant difference should be noted between restoring the loudness to loudness of the original signal without feedback performed by the gain processor 38, and restoring normal loudness perception for the hearing impaired listener performed by the loudness restoration processor 56 and including dynamic range compression in accordance with the hearing loss of the intended user of the hearing aid 10.

As previously mentioned, in principle, the agents 38, 54 and 56 in the gain-chain may be re-ordered, e.g., the gain processor 38 may be moved to the end of the chain. However, it is presently preferred to use the illustrated order so that the signal envelope is corrected before hearing loss dependent adjustments are performed, which may be non-linear and sound pressure dependent.

At the end of the gain-chain, the output gain vector 58 in the frequency domain is transformed back to the time domain using an Inverse Fast Fourier Transform (IFFT) 60 and used as the coefficient vector of the warped FIR filter. The gain vector 58 is also propagated back to the gain processor 38 to be used in the next gain determination.

Finally, the signal that has passed through the warped FIR filter 50 is output limited in an output limiter 62 to ensure that (possibly unknown) receiver 16 and/or microphone 16 non-linearities do not propagate along the feedback path. Otherwise the feedback suppression circuit 28 may fail to model large signal levels adequately. The output limiter 62 may be omitted. For example, output limiting may be provided by the dynamic range compressor or by other parts of the digital signal processing circuitry.

Below, the residual feedback signal is estimated by the gain processor 38 in a way different from the estimation scheme disclosed in EP 2 203 000 A1.

In the multiband hearing aid 10 shown in FIG. 5, the residual feedback signal $R_k$ is estimated by:

$$|R_k|=\beta|A_k||B_k| \tag{9}$$

Where $A_k$ is the feedback reference gain obtained from the feedback suppression circuit, $B_k$ is a potential band offset≥1 obtained from monitoring the input power spectrum, and the fractional residual error β is a scaling term which relates the residual feedback signal to the feedback reference level.

β and $A_k$ relate to the feedback suppression circuit 28 and they provide a proactive good estimate of the residual feedback signal so that residual feedback compensating gains are applied to the feedback compensated audio signal before instability occurs. However, in certain situations, e.g., during fast changes and/or large changes of the feedback path, the feedback suppression circuit 28 may adapt too slowly leading to significant residual feedback and possible instability. In these types of situations, the band offsets $B_k$ relating to the audio signal provide a significant contribution to the estimate of residual feedback so that feedback compensating gains are applied to overcome emerging instability.

Determination of the three terms $A_k$, $B_k$, and β, are disclosed in more detail below.

$A_k$:

Feedback reference gains $A_k$ are obtained from the transfer function of the feedback suppression circuit 28. In EP 2 203 000 A1, this was performed only at initialization, i.e. during fitting and/or at hearing aid turn on. The same method of obtaining the feedback reference gains $A_k$ may be used here.

However, preferably, the feedback reference gains $A_k$ are updated at regular time intervals during operation, e.g. following slow changes of the feedback suppression circuit 28, e.g. resulting from repeated insertion of the hearing aid in the ear canal of the user.

In the illustrated hearing aid 10 of FIG. 5, the transfer function of the feedback suppression circuit 28 is calculated for the warped frequency bands k, i.e. a Fourier transform is performed for the frequencies in question.

Preferably, for low frequency bands, $A_k$ is the value calculated at the centre frequency of the band in question, while for high frequency bands, the resolution is doubled by also calculating the Fourier transform at the border frequencies.

In this way, the transfer function is calculated for a number of bins, e.g. 22 bins, and the value $A_k$ is determined for each warped frequency band k by setting $A_k$ to the maximum value of the three nearest frequency bins, whereby the risk of under-estimation is suppressed.

Further, in the illustrated hearing aid 10 of FIG. 5, sudden changes are reduced by applying a first order low pass filter (not shown) to the transformed magnitudes in the log domain.

In order to save processing power, the Fourier transform may not be performed for all frequencies for each block of samples, e.g. the Fourier transform may be performed for one frequency only for each block of samples.

β:

In the illustrated hearing aid 10 of FIG. 5, β is calculated for every block of samples and is used for all frequency bands k as a scaling factor determining the magnitude of the residual feedback signal $|R_k|$ relative to the reference level $|A_k|$.

In EP 2 203 000 A1, β was the only adaptive mechanism while the reference gains $A_k$ were fixed between determinations at fitting or at hearing aid turn on. In the new hearing aid 10 and according to the new method with continuous updating of the reference gains $A_k$, β takes care of fast changes in the feedback path, while changes of longer duration will eventually be absorbed in the adaptive feedback reference gains $A_k$.

β is calculated from two orthogonal contributions, namely a static contribution representing an accuracy of the feedback suppression circuit under ideal conditions, e.g. due to limited precision; and a dynamic contribution representing inaccuracy due to changes in the feedback path which the feedback suppression circuit cannot track accurately.

For the static term, the residual error scales proportionally to the feedback magnitude in accordance with the following broadband 1-norm estimate:

$$\sigma_s=c_s\|\vec{h}_e*\vec{w}\|_1 \tag{10}$$

where $\vec{w}$ is the weight coefficient vector of the fast adaptive filter of the feedback suppression circuit, $\vec{h}_e$ is an optional frequency emphasis filter, * denotes convolution, and $c_s$ is a constant related to the expected static performance.

$\vec{w}_{ref}$ is the reference weight coefficient vector of the fast adaptive filter of the feedback suppression circuit. When $\vec{w}$ matches $\vec{w}_{ref}$, the response of the feedback suppression circuit equals the response of the fixed or slowly adaptive filter.

The dynamic part of β is determined by comparing the current feedback suppression circuit to the reference model:

$$\sigma_d=c_d\|\vec{h}_e*(\vec{w}-\vec{w}_{ref})\|_1 \tag{11}$$

where $c_d$ is a constant related to the expected dynamic performance.

Assuming that static and dynamic errors are orthogonal, the static and dynamic terms are combined according to:

$$\sigma^2=\sigma_s^2+\sigma_d^2 \tag{12}$$

The equation is further normalized with $$\sigma_{norm}=lpf\|\vec{h}_{emp}*\vec{w}\|_1 \tag{13}$$

This is a low-pass filtered version of the feedback suppression circuit norm wherein the adaptation rate matches the rate of the feedback reference gain A updates.

By combining the normalization with error estimate σ, β is determined by:

$$\beta=\frac{\sqrt{\left(c_s\|\vec{h}_{emp}*\vec{w}\|\right)^2+\left(c_d\|\vec{h}_{emp}*(\vec{w}-\vec{w}_{ref})\|\right)^2}}{\sigma_{norm}} \tag{14}$$

where for efficiency, the static part (with $c_s$) and normalization do not have to be updated for every block of samples due to assumed slow changes, while the dynamic part, i.e. the term $\|h_{emp}*(w-w_{ref})|$) may be updated for every block of samples whereby fast feedback suppression circuit changes are applied uniformly in all bands.

The determination of β may be further simplified by elimination of the frequency emphasis, i.e. $\vec{h}_{emp}$ is set equal to the 1.

$c_s$ and $c_d$ may be determined empirically, e.g. based on system performance, such as tracking accuracy in various situations.

Under stationary conditions, $\sigma_{norm}=\text{lpf}\|\overrightarrow{h_{emp}}*\vec{w}\|=\|\overrightarrow{h_{emp}}*\vec{w}\|$, so that equation (14) simplifies into:

$$\beta_{steady\ state}=\sqrt{c_s^2+\left(\frac{c_d\|\overrightarrow{h_{emp}}*(\vec{w}-\overrightarrow{w_{ref}})\|}{\sigma_{norm}}\right)^2}$$

The static part of the fractional residual error is determined by $c_s$, the other part accounts for the adapting feedback reference gains $A_k$.

Under stationary conditions, $|w-w_{ref}|$ is small so that $\beta_{steady\ state}\sim c_s$.

Under non-stationary conditions, $|w-w_{ref}|$ is large, and $\beta$ is scaled by $c_d$.

In some cases, $c_s$ and $c_d$ may range from 0.1 to 0.4, depending on a tradeoff between speed and accuracy of the feedback suppression circuit and assuming that the feedback reference gains $A_k$ are scaled to match the feedback level. For example, in a slow adapting system $c_s$ may be set to a small value due to expected better static performance while $c_d$ is set to a larger value larger due to larger expected deviations when a change occurs.

$B_k$:

In some situations, the feedback suppression circuit may be unable to adapt sufficiently to avoid feedback in response to changes in the feedback path. In this event, $\beta|A|$ underestimates the residual feedback signal, and this may lead to instability. In some cases, instability may be clearly audible and may be detected in the input power spectrum. Therefore, the new method includes provision of offsets $B_k$ in equation (9) in order to restore stability. Frequency bands k with persistent peaks are detected and corresponding offsets $B_k$ to the residual feedback signal estimate $R_k$ are provided in order to suppress the feedback signal.

For example, according to the new method, all frequency bands are classified as either a peak, valley or slope for each block of samples. A peak is a frequency band where the input power in neighboring bands is lower than the input power of the frequency band in question. A valley is a frequency band where the input power in neighboring bands is larger than the input power of the frequency band in question. When a frequency band is not a peak or a valley, it is a slope, which is ignored.

For a peak or valley frequency band, the band offset $B_k$ is incremented or decremented, respectively, in dB. Values are confined between 0 dB and a maximum value.

The peak probability is the probability of observing a peak when slopes are discarded, i.e. P(peak)+P(valley)=1.

The ratio between increment and decrement step sizes is determined by a peak probability threshold, whereby the peak probability threshold determines an upper limit on how often feedback peaks are allowed to occur in the input power spectrum, since by increasing band offset $B_k$ the probability of observing more peaks in band k will be reduced when the peak is caused by feedback. In practice this probability threshold is only used implicitly to determine the magnitude ratio between increments (for peaks) and decrements (for valleys). E.g., if a decrement is twice the size of an increment, gain reduction does not occur until at least twice as many peaks than valleys occur.

Step sizes, peak probability thresholds and maximum offset values can all be changed adaptively to make the algorithm more aggressive depending on the situation.

For an average signal the probability of detecting a peak is equal to the probability of detecting a valley. Since slopes are ignored the expected peak probability is 50%. The valid range of possible values for the peak probability threshold is therefore somewhere between 50% and 100%. For thresholds above 50% the decrements are always greater than the increments, so for average signals the band offsets remain close to the lower bound of 0 dB. When audible feedback occurs and dominates a specific band, the band offsets will increase until either the observed peak probability is reduced to the peak probability threshold, or the max band offset is reached.

Detection of peaks and valleys is sensitive to systematic offsets in the input power spectrum, which may, e.g., be caused by inaccuracies in the input calibration, unexpected peaks in transducer responses, specifically shaped background noises, uneven bandwidths caused by the frequency warping, etc. For optimal performance the input spectrum therefore has to be normalized adaptively.

The normalization values are updated using a conditional attack and release filter that attempts to identify the non-tonal ambient noise level. When the input signal is tonal, there may be feedback which should not be normalized away. So instead, for tonal input, the normalization slowly leaks to a flat response.

Since not all persistent peaks are caused by feedback, PPS increases the risk of over-estimating the residual feedback which can result in (excessive) gain reduction. To minimize undesired behaviour, the algorithm should therefore only be used aggressively in situations where there is a high risk of instability.

The risk of feedback instability can be determined from various features available in the system, for example: (1) the feedback level, determined by combining the forward path gain with the feedback path gain (to roughly determine the distance to the maximum stable gain value), (2) the distance to the reference, which accounts for all changes since the device was first fitted, and (3) the tonal signal power, which represents how predictable the input signal is (externally generated pure tones & feedback squealing are both highly predictable yet difficult to discriminate). The three features are combined into one value in a range between 0 and 1 denoted Peak Suppression Aggressiveness (PSA).

When the PSA is 0, a high peak probability threshold is combined with small step sizes. When the PSA is 1, a lower peak probability threshold is combined with larger step sizes. Between 0 and 1, a weighted combination is used.

When instability occurs in a hearing aid, the output level does not go to infinity (as one expects for the theoretical linear system). Instead it converges to a steady state level determined by the (non-linear) compression and limiting of the Adaptive Gain Controls (AGC's). Since for this steady state level the total loop gain is unity (i.e., $|GR|=1$) an upper bound on the residual feedback gain can be inferred by monitoring the lowest observed gain in the forward path. Using this bound to restrict the maximum band offset, taking care to distinguish between PPS' own contribution and that of other gain agents, ensures that PPS cannot react excessively to tonal input.

$\Delta g_k$

The desired gain is determined in accordance with equations (8) and (9). Equation (8) is rewritten in logarithmic form:

$$\Delta g_k = -10 \log_{10}(1+10^{0.1*L_k})) \quad (15)$$

With $$L_k = \beta_{dB} + G_{k_{dB}} + A_{k_{dB}} + B_{k_{dB}} \quad (16)$$

where $\Delta g_k$ is the target gain in dB, i.e. a target for the gain adjustment. The symbol $\Delta g_k$ is used in the logarithmic domain. Gains in the side branch may be calculated in the logarithmic domain.

In practice, $\Delta g_k$ is updated recursively based on the actual hearing aid gains provided at the output of the gain-chain, i.e. the output of loudness restoration processor 56, which includes the contribution of all gain agents, previous gains, and the feedback reference gains.

Since the various gains are updated in a closed loop, oscillations may occur. To reduce possibly disturbing gain fluctuations, the gain adjustments are smoothed using attack and release filters. Fast attacks may be used to react quickly to sudden changes in the feedback path. Potential oscillations are dampened by using a slow release time.

In the illustrated embodiment, the attack and release filters are applied in two stages. In the first stage, a feedback suppression circuit 28 broadband scaling factor β is smoothed with configurable attack and release rates. In the second stage, which is applied in each band, an instantaneous attack is combined with a slow fixed-step release.

Since calculations of logarithmic and exponential functions are quite complex and expensive in terms of processing power, the following approximations may be used instead:

$$\Delta g_k = \begin{cases} 0 & \forall L_k < -12 \\ \frac{1}{48}(L_k+12)^2 & \forall -12 < L_k < 12 \\ -L_k & \forall L_k > 12 \end{cases} \quad (17)$$

Figure 6:
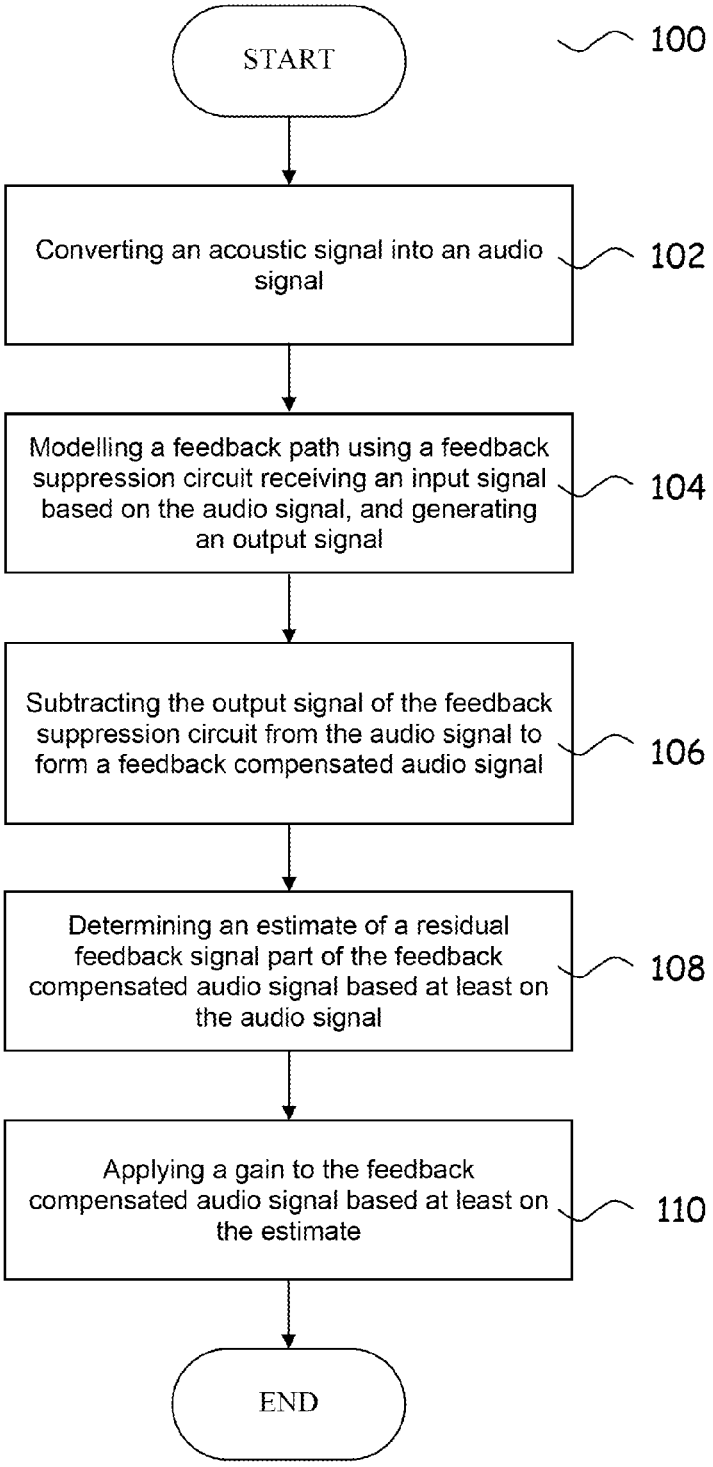
FIG. 6 shows a flow diagram of an embodiment of a method.

FIG. 6 is a flowchart of the new method 100 of suppressing residual feedback, comprising the steps of:

102: converting an acoustic signal into an audio signal,

104: modelling a feedback path using a feedback suppression circuit receiving an input signal based on the audio signal, and generating an output signal,

106: subtracting the output signal of the feedback suppression circuit from the audio signal to form a feedback compensated audio signal,

108: determining an estimate of a residual feedback signal part of the feedback compensated audio signal based at least on the audio signal; and

110: applying a gain to the feedback compensated audio signal based at least on the estimate.

Figure 7:
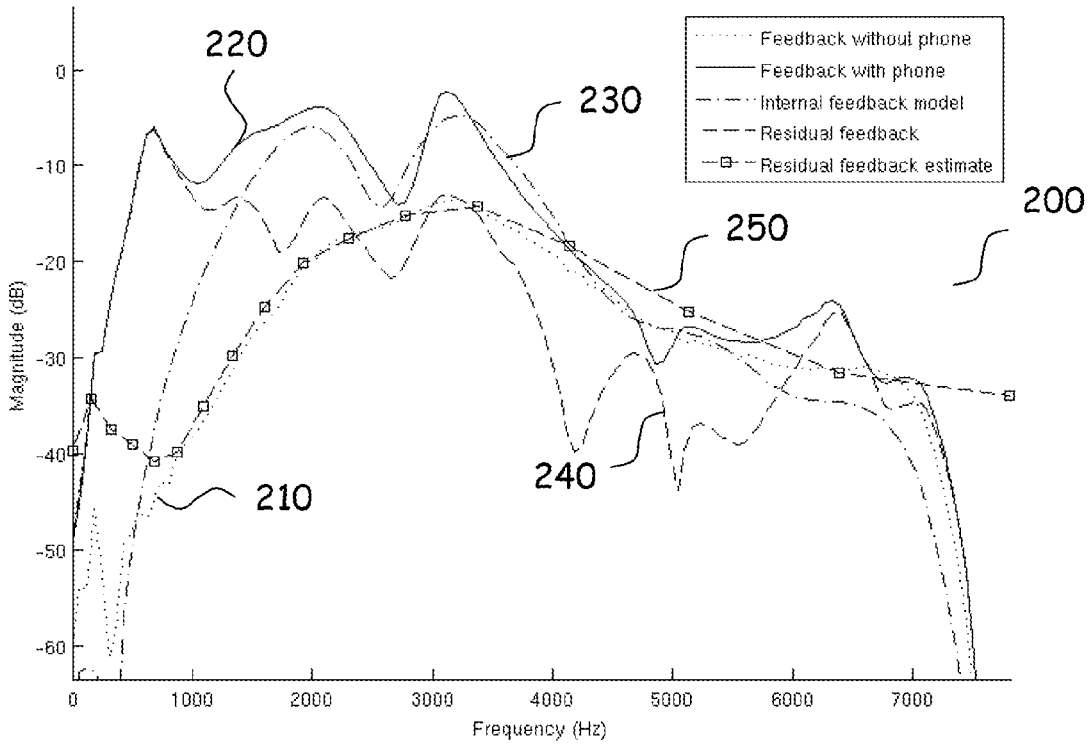
FIG. 7 shows plots of simulated feedback signals for a prior art hearing aid, and FIG. 8 show plots of simulated feedback signals for a hearing aid with a gain processor.
Figure 8:
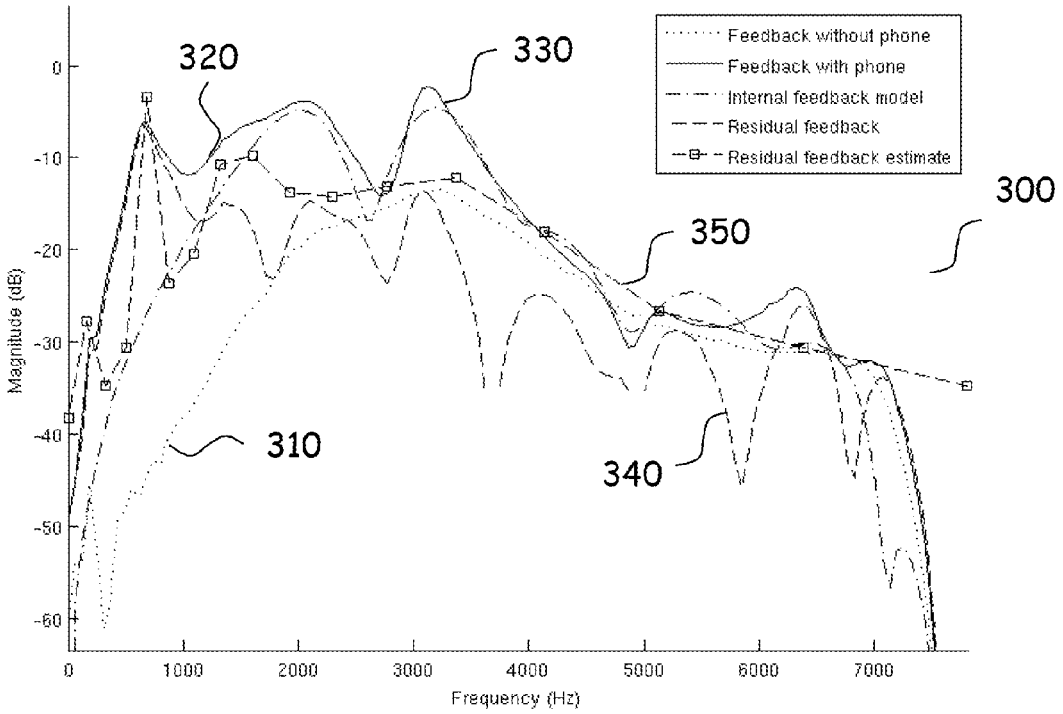

FIGS. 7 and 8 show plots 200, 300, respectively, of various feedback path related transfer functions for performance comparison. The simulation is performed with Matlab.

The plot 200 of FIG. 7 shows feedback related transfer functions for a hearing aid as disclosed in EP 2 203 000 A1 with a fixed filter 46. The plot 300 of FIG. 8 shows feedback related transfer functions for the hearing aid illustrated in FIG. 5 with a slow adaptive filter 46.

The lower dashed curves 210, 310 show the feedback path transfer functions with the hearing aids in their intended operating positions at the ear of the user, while the solid curves 220, 320 show the respective feedback path transfer functions when a telephone has been brought to the ear. A significant increase in the magnitudes of the transfer functions is noted.

The solid curves 230, 330 show the transfer functions of the feedback suppression circuit with the phone at the ear, and solid curves 240, 340 show the residual feedback path transfer functions with the phone at the ear.

The dashed curves with squares 250, 350 show the estimated residual feedback path transfer functions with the phone at the ear.

The estimate 350 of the new hearing aid is significantly improved over the prior art.

Although particular embodiments have been shown and described, it will be understood that they are not intended to limit the claimed inventions, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

an input transducer for generating an audio signal;

a feedback suppression circuit configured for modelling a feedback path of the hearing aid;

a subtractor for subtracting an output signal of the feedback suppression circuit from the audio signal to form a feedback compensated audio signal;

a signal processor that is coupled to an output of the subtractor for processing the feedback compensated audio signal to perform hearing loss compensation; and a receiver that is coupled to an output of the signal processor for converting the processed feedback compensated audio signal into a sound signal;

wherein the hearing aid further comprises a gain processor for performing gain adjustment of the feedback compensated audio signal based at least on an estimate of a residual feedback signal of the feedback compensated audio signal, wherein the estimate of the residual feedback signal is based at least on the audio signal, and wherein an amount of the gain adjustment is variable in response to a variability of the estimate of the residual feedback signal.

2. The hearing aid according to claim 1, wherein the feedback suppression circuit is configured during an initialization of the hearing aid, and wherein the estimate of the residual feedback signal is further based on a configuration of the feedback suppression circuit achieved during the initialization of the hearing aid.

3. The hearing aid according to claim 1, wherein the feedback suppression circuit has a configuration that is variable, and wherein the estimate of the residual feedback signal is further based on a configuration of the feedback suppression circuit as determined during a current operation of the hearing aid.

4. The hearing aid according to claim 1, wherein the estimate of the residual feedback signal is further based on a gain value of the hearing aid.

5. The hearing aid according to claim 1, wherein the feedback suppression circuit comprises an adaptive filter.

6. The hearing aid according to claim 1, wherein the gain processor and the signal processor are configured to respectively perform the gain adjustment and the hearing loss compensation separately.

7. The hearing aid according to claim 1, wherein the signal processor is configured to perform multi-band hearing loss compensation in a set of frequency bands k, and wherein the estimate of the residual feedback signal comprises estimates of the residual feedback signal in the frequency bands k.

8. The hearing aid according to claim 7, wherein the estimate of the residual feedback signal includes an estimate of an adaptive broad-band contribution β.

9. A hearing aid comprising:

an input transducer for generating an audio signal;

a feedback suppression circuit configured for modelling a feedback path of the hearing aid;

a subtractor for subtracting an output signal of the feedback suppression circuit from the audio signal to form a feedback compensated audio signal;

a signal processor that is coupled to an output of the subtractor for processing the feedback compensated audio signal to perform hearing loss compensation; and a receiver that is coupled to an output of the signal processor for converting the processed feedback compensated audio signal into a sound signal;

wherein the hearing aid further comprises a gain processor for performing gain adjustment of the feedback compensated audio signal based at least on an estimate of a residual feedback signal of the feedback compensated audio signal, wherein the estimate of the residual feedback signal is based at least on the audio signal;

wherein the signal processor is configured to perform multi-band hearing loss compensation in a set of frequency bands k, and wherein the estimate of the residual feedback signal comprises estimates of the residual feedback signal in the frequency bands k;

wherein the estimate of the residual feedback signal includes an estimate of an adaptive broad-band contribution β; and wherein the estimates $R_k$ of the residual feedback signal in the respective frequency bands k is given by $$|R_k| = \beta |A_k||B_k|$$

and an amount of the gain adjustment $\alpha_k$ is calculated from:

$$\alpha_k^2 = \frac{1}{(1 + \beta^2 |G_k|^2 |A_k|^2 |B_k|^2)}$$

wherein

β is a scaling term relating the residual feedback signal to a feedback reference, $A_k$ is a feedback reference gain obtained using the feedback suppression circuit, and $B_k$ is a contribution from the audio signal.

10. The hearing aid according to claim 9, wherein the feedback suppression circuit comprises an adaptive filter, and wherein β is calculated from:

$$\beta = \frac{\left(\left(c_s \left\|\overrightarrow{h_{emp}} * \vec{w}\right\|\right)^q + \left(c_d \left\|\overrightarrow{h_{emp}} * (\vec{w} - \overrightarrow{w_{ref}})\right\|\right)^q\right)^{\frac{1}{q}}}{\sigma_{norm}}$$

wherein q is an integer,

‖ ‖ indicates a p-norm of a vector, p is a positive integer, $c_s$ is a scaling factor relating to an accuracy of the feedback suppression circuit in modelling the feedback path in static situations, $c_d$ is a scaling factor relating to an accuracy of the feedback suppression circuit in modelling the feedback path in dynamic situations, $\overrightarrow{h_{emp}}$ represents a filter for emphasizing certain frequencies, $\vec{w}$ is the coefficient vector of the adaptive filter, $\overrightarrow{w_{ref}}$ is the reference coefficient vector of the adaptive filter, and $\sigma_{norm}$ is a low-pass filtered feedback suppression circuit norm $\sigma_{norm} = \mathrm{lpf}(\|\overrightarrow{h_{emp}} * \vec{w}\|)$.

11. The hearing aid according to claim 10, wherein q is equal to two.

12. The hearing aid according to claim 10, wherein $\overrightarrow{h_{emp}}$ is equal to one.

13. The hearing aid according to claim 10, wherein the p-norm is 1-norm.

14. The hearing aid according to claim 1, further comprising attack and release filters configured for smoothing process parameters in the gain processor.

15. A method of suppressing residual feedback, comprising:

converting an acoustic signal into an audio signal;

modelling a feedback path using a feedback suppression circuit receiving an input signal based on the audio signal, and generating an output signal;

subtracting the output signal of the feedback suppression circuit from the audio signal to form a feedback compensated audio signal;

determining an estimate of a residual feedback signal part of the feedback compensated audio signal based at least on the audio signal; and applying a gain to the feedback compensated audio signal based at least on the estimate;

wherein the estimate of the residual feedback signal part is based at least on the audio signal; and wherein an amount of the gain is variable in response to a variability of the estimate of the residual feedback signal.

16. The method according to claim 15, further comprising monitoring the feedback path, wherein the estimate of the residual feedback signal part is based on a result from the act of monitoring.

* * * * *